350-1.5 SR
9/15/81 XR 4,288,953

United States Patent [19]

Whiteford

[11] 4,288,953

[45] Sep. 15, 1981

[54] THERMAL AND OPTICAL MULTI-MODE WINDOW

[76] Inventor: Carl Whiteford, 3 High Point Rd., Westport, Conn. 06880

[21] Appl. No.: 150,208

[22] Filed: May 15, 1980

[51] Int. Cl.[3] ..... E06B 7/12

[52] U.S. Cl. ..... 52/171; 52/788; 350/312; 350/1.5; 350/267

[58] Field of Search ..... 52/171, 788, 790, 806, 52/807, 200; 350/312, 1.5, 267, 319; 428/34, 116

[56] References Cited

U.S. PATENT DOCUMENTS

| | | | |
|---|---|---|---|
| 3,981,294 | 9/1976 | Deminet et al. | 52/788 X |
| 4,044,519 | 8/1977 | Morn et al. | 350/312 X |
| 4,074,482 | 2/1978 | Klahr | 52/171 |
| 4,093,352 | 6/1978 | Pisar | 52/171 X |
| 4,236,360 | 12/1980 | Parrier et al. | 52/171 |

*Primary Examiner*—Carl D. Friedman
*Attorney, Agent, or Firm*—Martin D. Wittstein

[57] ABSTRACT

A thermal and optical multi-mode window is disclosed in which a window panel can be converted from thermally insulating but optically diffuse to optically clear but thermally semi-insulating, or at least much less insulating. The window panel is made of a transparent plastic material such as Lucite acrylic and is constructed of a plurality of sheet-like layers with air cells interspersed therebetween. When the cells are empty, the panel is highly insulating but is not optically clear like ordinary window glass. However, when the cells are filled with a clear liquid which has the same index of refraction as that of the acrylic material, all of the interior surfaces of the acrylic material disappear from view and the panel is then as optically clear as ordinary window glass, but not as thermally insulating, as when the cells contain air.

7 Claims, 6 Drawing Figures

FIG. 1
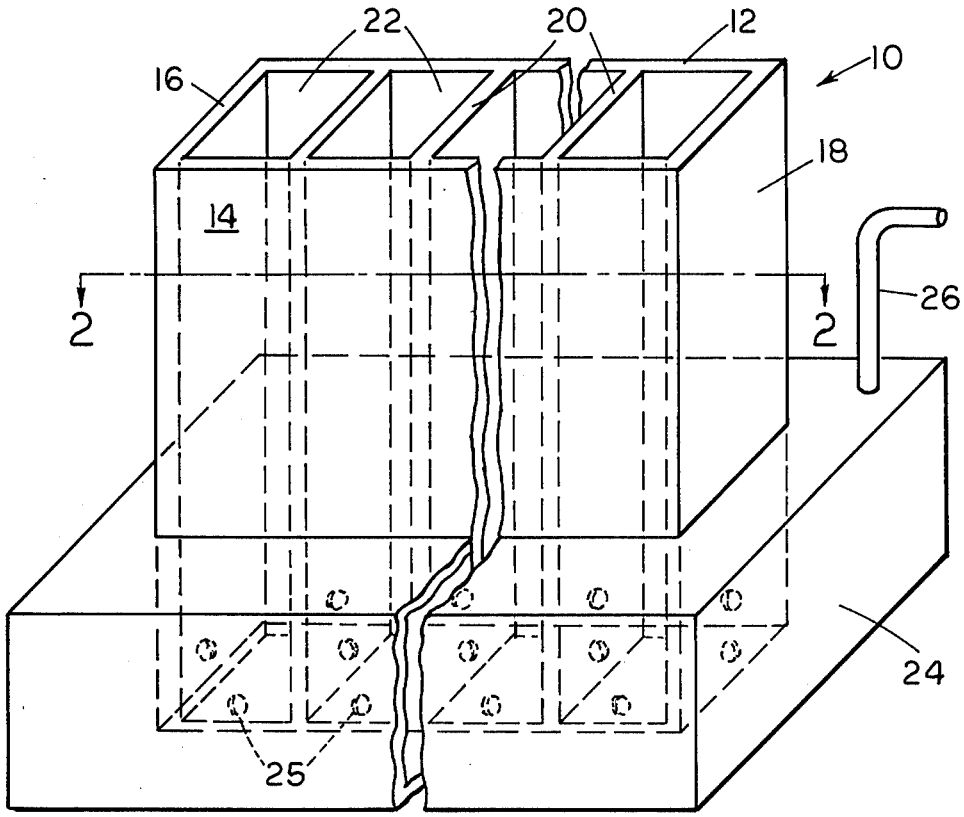
FIG. 2
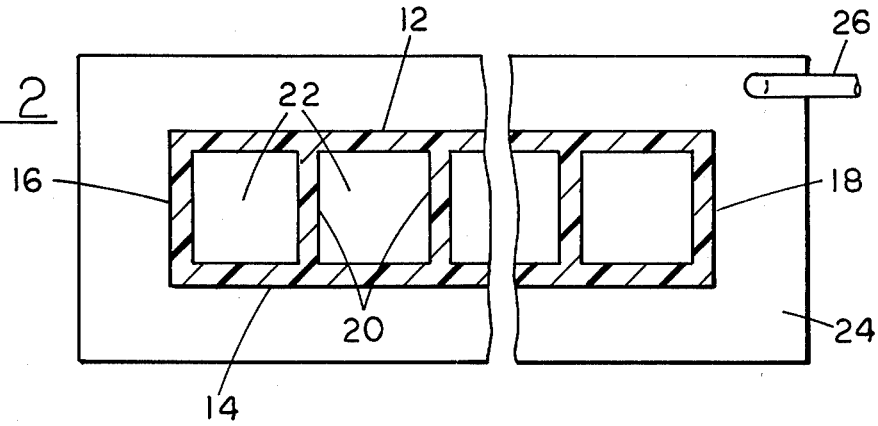
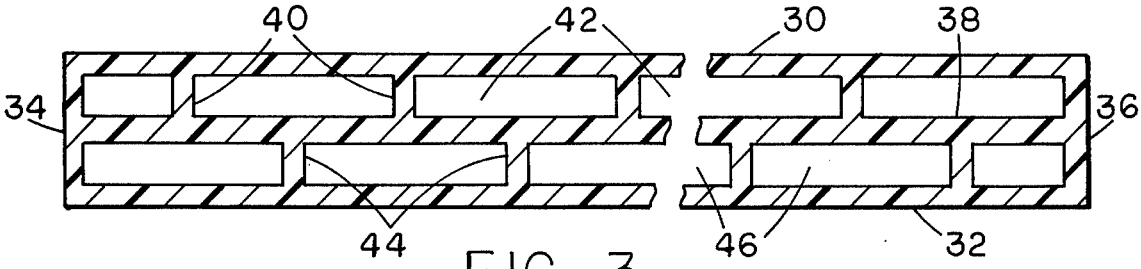
FIG. 3

THERMAL AND OPTICAL MULTI-MODE WINDOW

BACKGROUND OF THE INVENTION

Under present day conditions of world-wide shortages of energy, great emphasis is placed on the design and development of systems and devices for conserving energy in whatever form it exists. One form in particular, heat, is especially important to conserve because it is so costly to generate and so easily lost. The sharply rising costs of fuel oil in the past year of so has resulted in particular focus being directed toward systems and devices for generating heat from alternate sources of energy, and for reducing the loss of heat from residential and commercial buildings in the frigid climates.

By considering measures to reduce heat loss from buildings, an immediate concern is the problem of reduction of heat loss through windows. This problem is especially acute in residential buildings where windows are a necessity, as distinguished from commercial buildings where windows are not a necessity since, more and more in modern buildings, the environment with respect to both light and heat is entirely artificial. Various systems and materials have been devised to reduce heat loss through walls and roofs but very little has been accomplished to reduce heat loss through windows. The almost universal approach to reducing heat loss through windows is the standard double pane window panel formed of two layers of glass with a dead or stagnate trapped air space therebetween. Trapped air is a well-known and highly effective means of insulation, and is very effectively used in thermally insulating windows because the air space can be easily sealed. As a matter of fact, this is also true for doors, and many thermally insulating doors are constructed on the same principle.

While insulating windows and doors have greatly improved with respect to such characteristics as ease and convenience of storing, removing, opening, mounting or operating, as well as manufacturing techniques, frame materials and designs to reduce cost, very little, if anything has been done to improve the most significant characteristic of any thermally insulating window, i.e., its thermal insulation capability. It should be obvious to anyone that any window which can maintain an interior face temperature of 70° when the exterior face temperature is 20° is substantially more thermally insulating and therefore more energy efficient than a window which can maintain only a 30° deferential under the same conditions.

Presently existing thermally insulating windows are not as thermally insulating as they could be for two principle reasons, firstly that they are made of glass which is itself an excellent heat conducting material, and secondly that there is only one air space between the two layers of glass so that the window will be as optically clear as possible to afford undistorted vision through the window. It is well known that the more layers of glass in the window, the more likelihood there is for optical distortions. Therefore, a compromise is sought between insulating capacity, optical clarity and costs with the result that relatively inefficient thermally insulating windows are available, at high cost.

My invention hereinafter disclosed and claimed seeks to entirely eliminate the need for the above mentioned compromise by taking full advantage of both thermal insulation and optical clarity characteristics in a multi-mode window.

BRIEF DESCRIPTION OF THE INVENTION

This invention relates generally to the field of energy conservation devices and more particularly to a novel thermally insulating window.

My invention is directed toward obviating or substantially eliminating the disadvantages of presently available thermally insulating windows while at the same time improving the advantages thereof. More specifically, my invention combines, in a single window, both the capability of having a high degree of thermal insulation without regard for loss of optical clarity, and good optical clarity without regard for loss of thermal insulation. This is accomplished by providing, in the structural configurations as described herein below, a window which functions in a multi-mode manner to provide the maximum of that characteristic which is desired at a given time.

By its broader aspects, a preferred embodiment of my invention composed of a window panel constructed to be diversionally and structurally received within a standard window frame and having a plurality of layers of a relatively thin transparent material disposed in spaced apart planar parallel relationship. A plurality of transversely disposed spaced apart web members formed of the same material as the parallel layers of material extend between the layers of clear material and divide the space therebetween into a plurality of spaced apart voids or vertical cells. The window panel includes a source of clear liquid having an index of refraction which is matched to the index of refraction of the plastic material. There is also provided a liquid flow communication between the liquid storage source and the plurality of voids, any suitable means for transferring the liquid to flow from the storage source into the voids to thereby fill them with the liquid, must be provided.

See a particularly preferred embodiment of the invention, there are four layers of essentially parallel plastic material providing three separate interior air spaces which are divided into separate rows of spaced apart voids or air cells by transverse web members extending between adjacent layers of material, with the transversely disposed web members defining any one of said rows of voids being purposely misaligned with the transversely disposed web members of an adjacent row of voids, thereby defining a tortuous path of solid material between the outermost layers of parallel plastic material. By this construction, maximum thermal insulation is obtained for a given thickness of window panel because the window panel is made of an acrylic material which has a lower rate of heat conductivity than does glass, and the design provides a very long thermal conductive path from one exterior panel face to the other thereby providing a plurality of individual and subdivided trapped air cells.

A window structured this way, even of crystal clear material, is not optically clear. Because of all the interior layers and the transverse web members, it is sufficiently internally reflective, that, while light readily passes through the window, an observer cannot distinguish sharply defined objects on the opposite side of the window panel. Vision is distorted, as if looking through stall shower glass, or through a thin scrim material or cloth curtain across the window, and objects cannot be distinguished with clarity. However, by merely filling the air cells with a clear transparent liquid, such as a suitable mixture of glycerine and water, having the same exact index of refraction as that of the transparent material of which the window panel is formed, all of the interior surfaces and web members entirely disappear from view and the entire window becomes as optically clear and undistorted as any conventional glass window pane, thermally insulating or otherwise. The particular composition of the liquid is not critical to the invention so long as the composition meets the critical requirements of being optically clear and preferably colorless and having an index of refraction matched to that of the plastic material from which the window panel is formed, and a freezing point of at least 0° F.

A coloring material could be added to the liquid if it is desired to have a colored window when the window panel is in the optically clear see thru mode having liquid in the air cells. However, the liquid would still have to be clear, that is, not appear clouded, etc., even with coloring matter added.

Having briefly described the general nature and construction of the present invention, it is a principal object thereof to provide a novel window construction which can function either in a thermally insulating or optically clear mode.

It is another object of the present invention to provide a thermal and optical multi-mode window which provides a maximum degree of thermal insulation in one mode and a maximum degree of optical clarity in another mode in a construction in which both cannot exist simultaneously.

It is still another object of the present invention to provide a movable thermal and optical multi-mode window panel in which the change from the thermally insulating mode to the optically clear mode can be achieved automatically, or with a minimum amount of effort, with the window panel in place and very rapidly.

It is yet another object of the present invention to provide a thermal and optical multi-mode window which is substantially unbreakable in the context of ordinary usage, and which is esthetically pleasing and can be made to be retrofittable into existing standard window frames.

These and other objects and advantages of the present invention will be more readily apparent from an understanding of the following detailed description of preferred embodiments of the present invention when considered in conjunction with the accompanying drawings in which:

FIG. 1 is a perspective view of a window panel constructed in accordance with the principle of the present invention, but intended primarily to illustrate the optical principles involved and not the preferred construction of a commercially acceptable embodiment of the invention.

FIG. 2 is a horizontal sectional view of the window panel shown in FIG. 1, taken on the line 2—2 of FIG. 1;

FIG. 3 is a view similar to FIG. 2 of a more preferred embodiment of the present invention;

Figure 4:
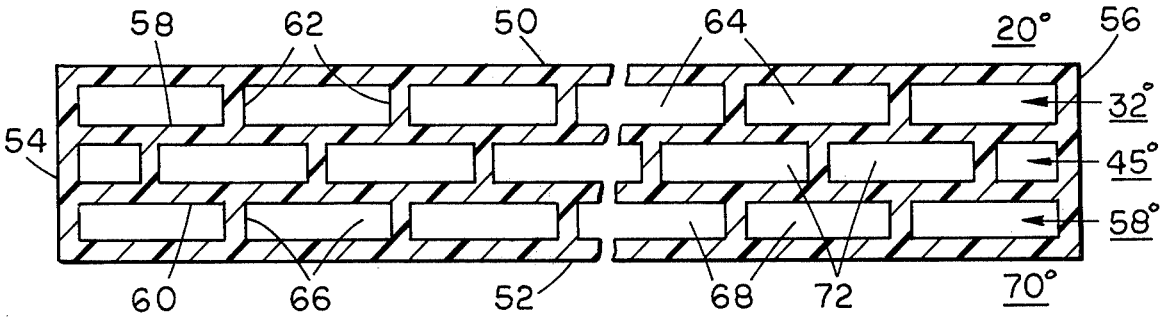
FIG. 4 is a view similar to FIG. 2 of a still more preferred embodiment of the present invention.

Referring now to the drawings and particularly in FIGS. 1 and 2 thereof, the principles of the present invention are illustrated in a window panel section generally designated by the reference numeral 10. The panel consists of generally rectangular, relatively thin cellular construction having a pair of relatively thin, transparent layers or facing walls 12 and 14 in the form of thin material. See the embodiment of the invention shown in FIG. 1, the layers 12 and 14 constitute the outer walls of the window panel 10 since there are only two such layers. These walls are connected by end walls 16 and 18 which are of the same thickness as the outer walls 12 and 14 and formed of the same material. Thus, these walls define an enclosure which is representative of a window panel which would be dimensioned to correspond generally to window frames currently found in use in residential or commercial buildings, which dimensionally and structurally fit within a window framing and are normally retained therein. The physical dimensions and size of the window panel have no bearing on the invention except as specifically discussed hereinafter and a further description thereof will be limited to such exception.

Referring again to FIGS. 1 and 2 the window panel 10 also includes a plurality of transversely disposed, spaced apart web members 20 which extend between the outer walls 12 and 14 and divide the total air space enclosed by the outer walls 12, 14, and the end walls 16 and 18 into a plurality of vertically oriented voids or cells 22. The web members 20 are preferably of the same thickness as the rest of the walls and are made of the same transparent material. Any number of transverse web members 20 may be provided and the spacing between them may vary and the spacing between each may vary. Since the window panel shon in FIGS. 1 and 2 is shown only for the purpose of illustrating the principles of the invention, further discussion of the spacing of the web members 20 and the shape of the air cells 22 will be given hereinbelow in connection with a description of the preferred embodiments of the invention.

In addition to the outer walls 12 and 14, the end walls 16 and 18 and the transverse web members 20, the panel 10 includes a means for storing a supply of a liquid, the composition and purpose of which will be discussed below, and a means for forcing the liquid from the supply source into the cells 22. Thus, as shown in principle in FIG. 1, the panel includes a lower portion 24 which preferably will be slightly larger volumetrically than the enclosure defined by the walls 12, 14, 16 and 18 and which constitutes a reservoir for the filling liquid. The four walls and the transverse web members 20 all extend into the reservoir 24 and are provided with any suitable means 25 such as apertures, notches, grooves, etc., so as to provide for fluid communication between the liquid in reservoir 24 and the air cells 22. In order to force the liquid from the reservoir into the air cells 22, a tube 26 is provided which communicates with the interior of the reservoir and through which air is forced under low pressure so that the liquid is forced to rise in the air cells 22. Except for the tops of the air cells 22, the top of the reservoir is otherwise sealed in any suitable manner so that the air is trapped between the upper portion of the reservoir and the surface of the liquid, thereby forcing the liquid to rise in the air cells 22. It will be understood that the tube 26 is merely illustrative of any suitable or convenient means for forcing the liquid from the reservoir 24 to the air cells 22.

As thus far described, the principles and operation of the invention can be fully explained with reference to the discussion of the Background of the Invention set forth herein above. The walls 12, 14, 16 and 18, as well as the transverse web members 20 are all made of a transparent material such as glass or clear plastic or acrylic material such as the well known Lucite or Plexiglass acrylics. When the air cells are empty, the panel 10 is not optically clear but rather would present an optically diffused or out of focus appearance to anything observed through the window. The degree of diffusion would vary under varying conditions of wall thickness, number of walls being looked through and the angle at which an observer looks through the walls. With the air cells 22 empty, however, maximum thermal insulation is obtained between the opposite outer walls of the window panel when a temperature differential exists therebetween.

When air is forced through the tube 26 and into the reservoir 24, the liquid, which has an index of refraction matched to the index of refraction of the transparent wall material, rises in the air cells 22 and wets all of the internal walls 12, 14, 16 and 18 and the transverse members 20, with the result that the visibility of the air cells 22 and the transverse webs disappear and the window panel 10 becomes as optically clear as any conventional window made of clear plastics. As previously indicated, however, the window 10 in this condition is not nearly as insulating as when the air cells 22 are empty for the reason that heat on one side of the window panel now has a direct means of conduction to the other side of the panel through the plastic sheet material layers 12 and 14, the intermediate web members 20 and the liquid in the air cells which is not a good thermal insulating material.

While the embodiment of the invention shown in FIGS. 1 and 2, and the above description show and describe the principles of the invention, the device is not particularly efficient in operation due to the single row of air cells and the relatively large cells. The more layers of air cells that can be provided, the greater will be the thermal insulating efficiency of the window panel. Accordingly, FIG. 3 illustrates a more preferred embodiment of the invention in which there is a pair of outer walls 30 and 32 and a pair of end walls 34 and 36 which correspond to the outer and end walls 12, 14, 16 and 18 shown in FIGS. 1 and 2. However, disposed between the outer walls 30 and 32 is another layer of thin clear material forming an intermediate wall 38. The intermediate wall 38 is formed of the same material as the other walls, making up the window panel and preferably is of the same thickness as the walls 30 and 32.

A plurality of transversely disposed, spaced apart, web members 40 is disposed between the outer wall 30 and the intermediate wall 38, which divide the space between these walls into a plurality of voids or air cells 42. Also, a plurality of similar transversely disposed spaced apart web members 44 is disposed between the other outer wall 32 and the intermediate wall 38, which divide the space between these walls into a plurality of voids or air cells 46. It will be noted that the transversely disposed web members 40 and 44 are misaligned with each other, and preferably are misaligned by an equal amount in both directions so that a web member 40 is aligned with the mid-point between adjacent web members 44. The reason for this is so that a direct path through the plastic material from one side of the window panel to the other will be as long as possible, thereby reducing to a minimum the extent of thermal conductivity of the window panel material when it is in the insulating mode. Also, with this construction, the insulating efficiency of the air cells 42 and 46 is greater than that of the air cells 22 in FIGS. 1 and 2. The reason for this is that the cumulative effect of the insulating efficiency of each smaller dead air space 42 and 46 is greater than the same thickness of air space 22 when it is undivided as in the FIGS. 1 and 2 embodiment.

FIG. 4 illustrates a still more preferred embodiment of the invention in which there is a pair of outer walls 50 and 52 and a pair of end walls 54 and 56 which again correspond to the outer and end walls 12, 14, 16 and 18 shown in FIGS. 1 and 2. In this embodiment there are two interior layers of thin clear material forming two intermediate walls 58 and 60. Again the intermediate walls 58 and 60 are formed of the same material as the other walls making up the window panel and preferably are of the same thickness as the walls 50 and 52.

A plurality of the transversely disposed, spaced apart web members 62 is disposed between the outer wall 50 and the intermediate wall 58, which divide the space between these walls into a plurality of voids or air cells 64. A plurality of similar transversely disposed spaced apart web members 66 is disposed between the other outer wall 52 and the other intermediate wall 60, which divide the space between these walls into a plurality of voids or air cells 68. Finally, there is still another plurality of transversely disposed, spaced apart web members 70, which divide the space between the two intermediate walls into a plurality of voids or air cells 72. It will be noted that the transversely disposed web members 62 and 66 are each misaligned with the transversely disposed web members 70 by an equal amount in both directions so that the web members 62 and 66 are aligned with the midpoint between adjacent web members 70. Thus, when viewed in section as in FIG. 4, the voids or air cells present a brick-like pattern so that, as with the previously described embodiment, a direct path through the plastic material from one outer face or wall of the window panel to the other will be as long as possible so as to reduce to a minimum the extent of direct thermal conductivity through the window panel.

Another advantage of the brick-like pattern of the air cells is that the total structure is relatively more resilient than a pattern with the air cells all aligned with the result that a window utilizing the brick pattern is more resistant to blows or impact. Any pressure exerted on either outer face of the window will be partially absorbed by the somewhat spring-like resiliency of all of the inner members of the structure.

Another reason for the preference of the brick-like pattern shown in FIG. 4 is that this pattern lends itself most closely to providing the maximum extent of thermal insulation within dimensions typically found in thermally insulating windows. With wall thicknesses of 1/16" and holding to a total window thickness of $\frac{5}{8}$", the window would provide a temperature gradient calculated at the figures shown in FIG. 4, that is, with a 20° F. outside temperature, the air in the first row of air cells 64 would be about 32°, in the second row of air cells 72 would be about 45°, in the third row of air cells 68 would be about 58°, and on the inside of the window panel would be about 70° F. By holding the total thickness of the window panel to $\frac{5}{8}$" it can be retrofitted to existing window frames with a minimum of modification.

Figure 5:
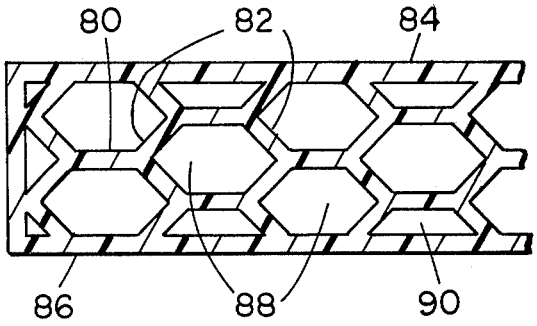
FIGS. 5 and 6 are views similar to FIG. 2 of other embodiments of the invention representing assymetrical configurations of window panels.
Figure 6:
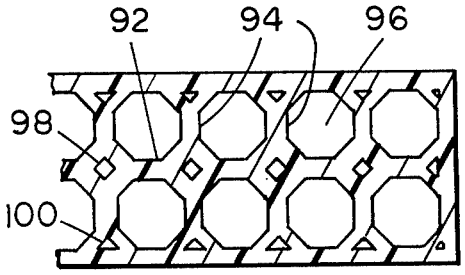

The cross-sectional shape of the internal air cells is not limited to the generally rectangular shape shown in the figures described above. Other shapes are contemplated within the scope of the invention since the whole window panel can be made by continuous extrusion from a single complex die and the plastic material can be extruded in virtually any shape which is desired including very intricate honey-comb shapes. FIGS. 5 and 6 show two possible configurations utilizing a combination of six sided polygons with parallelograms and eight sided polygons with squares and triangles respectively. See FIG. 5, an interior wall 80 is discontinuous or interrupted and the transversely disposed web members 82 are at an angle to the side walls 84 and 86 and are interconnected with the discontinuous portions of the intermediate wall 80, so that the six sided polygons 88 and the parallelograms 90 are formed. See FIG. 6, the intermediate wall 92 and the transversely disposed web members 94 are merely provided with appropriate sides and angles so as to form the eight side polygons 96, the squares 98, and the triangles 100, although the squares and triangles may be omitted if desired. Regardless of the shape of the air cells and the number of rows thereof, as soon as they are filled with the clear liquid having the same index of refraction as that of the plastic material, all of the interior walls completely disappear from view and the window panel becomes crystal clear.

I claim:

1. A thermal and optical multi-mode window comprising:

A. A window panel constructed to be dimensionally and structurally received within a window frame and normally adopted to be retained therein, said window panel comprising (1) a plurality of layers of relatively thin transparent material disposed in spaced apart parallel relationship, and (2) a plurality of transversely disposed, spaced apart web members formed of the same material as said layers of material and extending between said layers of material thereby dividing the space between said layers of material into a plurality of spaced apart voids, B. a source of clear liquid having an index of refraction which is matched to the index of refraction of said material, C. means providing liquid flow communication between said liquid source and said plurality of voids, and D. means for causing said liquid to flow from said liquid source into said voids to fill the latter whereby said window panel changes from optically diffuse to optically clear.

2. A window as set forth in claim 1 wherein said window panel includes

A. at least three layers of said transparent material all disposed in equally spaced apart planar parallel relationship, and B. a plurality of said transversely disposed web members extending between adjacent layers of said material thereby defining at least two rows of said spaced apart voids.

3. A window as set forth in claim 2 wherein the transversely disposed web members defining one of said rows of voids are misaligned with the transversely disposed web members defining an adjacent row of voids whereby a tortuous path is formed between the outermost of said layers of material.

4. A window as set forth in claim 3 wherein said plurality of transversely disposed web members are spaced apart by a distance greater than the spacing between adjacent layers of said material, thereby defining elongate shaped voids.

5. A window as set forth in claim 1 wherein said window panel includes

A. four layers of said transparent sheet material all disposed in spaced apart planar parallel relationship, and B. a plurality of said transversely disposed web members extending between adjacent layers of said material thereby defining three rows of spaced voids.

6. A window as set forth in claim 5 wherein the transversely disposed web members defining the middle of said three rows of voids are misaligned with the transversely disposed web members defining the two outer rows of voids whereby a tortuous path is formed between the outermost of said layers of material.

7. A window as set forth in claim 1 wherein said window panel includes

A. at least three layers of transparent material, the middle of the three layers being discontinuous but otherwise disposed in equally spaced apart relationship with the two outer layers, and B. a plurality of said transversely disposed web members extending at an angle to said two outer layers to interconnect the discontinuous portions of said intermediate layer.

* * * * *